US006161970A

United States Patent [19]

Sakata

[11] Patent Number: 6,161,970

[45] Date of Patent: Dec. 19, 2000

[54] METHOD OF OPERATING PHOTOSENSITIVE MATERIAL PROCESSING APPARATUS

[75] Inventor: Masamitsu Sakata, Kanagawa, Japan

[73] Assignee: Fuji Photo Film Co., Ltd., Kanagawa, Japan

[21] Appl. No.: 09/333,943

[22] Filed: Jun. 16, 1999

[30] Foreign Application Priority Data

Jun. 16, 1998 [JP] Japan ..... 10-168828

[51] Int. Cl.[7] ..... G03D 3/08

[52] U.S. Cl. ..... 396/612; 396/619; 396/617

[58] Field of Search ..... 396/612, 617, 396/620, 632; 134/64 R, 64 P, 122 P, 122 R; 101/483; 355/27–29

[56] References Cited

U.S. PATENT DOCUMENTS 4,931,378 6/1990 Hirano et al. ..... 396/620

5,446,516 8/1995 Burbury et al. ..... 396/626

5,669,035 9/1997 Kurematsu et al. ..... 396/626

*Primary Examiner*—D. Rutledge

*Attorney, Agent, or Firm*—Sughrue, Mion, Zinn, Macpeak & Seas, PLLC

[57] ABSTRACT

As developing processing operation is completed, driving of a motor is stopped so that rotation of conveying rollers is stopped. Then, in association with stopping of the conveying rollers, a timer is started. At a time when the timer has counted a specified amount of time, a controller rotates the conveying rollers for a predetermined amount of time, and then stops rotation thereof. When the rotation of the conveying rollers is stopped, the timer is reset and is restarted. Above operations are repeated intermittently at the time when the timer has counted the specified amount of time. Alternatively, the timer may be started when power of a photosensitive material processing apparatus is turned off. Further, the timer may be started in association with a predetermined control (such as preheating) for the photosensitive material processing apparatus.

26 Claims, 8 Drawing Sheets

METHOD OF OPERATING PHOTOSENSITIVE MATERIAL PROCESSING APPARATUS

BACKGROUND OF THE INVENTION

1. Field of the Invention

The present invention relates to a method of operating a photosensitive material processing apparatus for processing a photosensitive material by immersing the photosensitive material in processing solutions stored in a series of processing tanks. More particularly, the present invention relates to a method of operating a photosensitive material processing apparatus such as a printer processor in which conveying rollers nip a photosensitive material and convey the photosensitive material in respective processing tanks.

2. Description of the Related Art

Generally, a plurality of processing tanks which store water or processing solution for color development, bleach-fixing, rinsing, stabilization and the like are set in a photosensitive material processing apparatus (for example, a printer processor or the like) which is an automatic photo processor. A photosensitive material such as a photographic printing paper is sequentially conveyed into these processing tanks, and is immersed while being conveyed to thereby be processed.

A processing rack provided with plural sets of conveying rollers, each set having plural rollers, is inserted in each processing tank. During processing, these conveying rollers nip the photosensitive material therebetween such that the photosensitive material can be conveyed along the rack.

Usually materials such as silver, sulfides and the like are suspended in the processing solution. Therefore, there is the possibility that some of such suspended materials may deposit on the conveying rollers at the time the conveying rollers are stopped.

A photo processing laboratory generally stops operation of their photosensitive material processing apparatus in the evening, and starts operation up again either the next morning or the morning two days later (in the case that the next morning is a holiday, for example). Thus, when a photosensitive material processing apparatus which has been stopped for hours or days is started again, the materials deposited on the conveying rollers may adhere to the first photosensitive material passing between the conveying rollers after starting the apparatus. Such a transfer of deposited materials onto to the photosensitive material results in degradation of the quality of the photosensitive material.

In short, if a motor for rotating the conveying rollers has not been driven for a long time, the materials suspended in the processing solution tend to be deposited on the conveying rollers, and form precipitates thereon as time passes. Then, at the time when the conveying rollers start to rotate, the materials which have precipitated on the conveying rollers are likely to be transferred to the photosensitive material, and this inevitably causes dirtying of the photosensitive material.

SUMMARY OF THE INVENTION

With the aforementioned in view, an object of the present invention is to provide a method of operating a photosensitive material processing apparatus in which, even if rotation of conveying rollers has stopped for a long time, depositing and precipitation of suspended materials in the solution on the conveying rollers is reliably prevented such that deposited materials are not transferred onto the photosensitive material which would result in degradation of the quality thereof.

A first aspect of the present invention is a method of operating a photosensitive material processing apparatus in which a processing rack is set in each of at least one processing tanks which each store a processing solution, the processing rack rotatably supporting conveying rollers for conveying a photosensitive material, the method comprising the steps of: starting a timer when the rotation of the conveying rollers is stopped; rotating the conveying rollers for a predetermined amount of time at the time when the timer has counted a specified amount of time, and then stopping the rotation of the conveying rollers on the basis of a command from a controller; resetting and restarting the timer when the rotation of the conveying rollers is stopped; and repeating the above steps.

In accordance with the first aspect of the present invention, the following operations are carried out.

A processing rack which rotatably supports the conveying rollers for conveying the photosensitive material is set in each of the processing tanks which each store a processing solution.

The timer is started when the rotation of the conveying rollers stops. At the time when the timer has counted a specified amount of time, the controller rotates the conveying rollers for a predetermined amount of time, and then stops the rotation thereof again. When the rotation of the conveying rollers stops, the timer is reset and restarted so as to begin counting again. At the time when the timer has counted the specified amount of time, the controller repeats the same operations as described above.

Accordingly, because long-term stoppage of the conveying rollers can be prevented, materials suspended in the processing solution in the processing tank are much less likely to be deposited on and precipitated on the conveying rollers. Thus, at the time when the conveying rollers start to rotate again, very little dirt such as deposited materials is transferred to the photosensitive material, and therefore the photosensitive material is not dirtied.

As a result, even if rotation of the rollers has been stopped for a long period of time (such as cases in which the rollers are stopped when the temperature of the processing solution is being adjusted by a heater or cases in which the power of the photosensitive material processing apparatus is off), the deposition and precipitation of the suspended materials on the conveying rollers is reliably prevented, so that the high quality of the photosensitive material can be maintained.

A second aspect of the present invention is a method of operating a photosensitive material processing apparatus in which a processing rack is set in each of at least one processing tanks which each store a processing solution, the processing rack rotatably supporting conveying rollers for conveying a photosensitive material, the method comprising the steps of: starting a timer when the power of the photosensitive material processing apparatus is turned off; turning the power of the photosensitive material processing apparatus on at the time when the timer has counted a specified amount of time, and rotating the conveying rollers for a predetermined amount of time on the basis of a command from a controller; stopping the rotation of the conveying rollers, and turning the power off in the state in which the rotation of the conveying rollers is stopped; resetting and restarting the timer when the power is turned off; and repeating the above steps.

In accordance with the second aspect of the present invention, in the same way as in the first aspect, a processing rack which rotatably supports the conveying rollers for conveying the photosensitive material is set in each of the processing tanks which each store a processing solution.

The timer is started when the power of the photosensitive material processing apparatus is turned off. At the time when the timer has counted a specified amount of time, the controller turns the power on, and rotates the conveying rollers for a predetermined amount of time. Then, the controller stops the rotation of the conveying rollers, and turns the power off again.

Then, when the power is turned off, the timer is reset and is started again. At the time when the timer has counted the specified amount of time, the controller repeats the same operations as described above.

Accordingly, even if the power is turned off, the deposition and precipitation of the suspended materials on the conveying rollers is reliably prevented as in the first aspect, so that the high quality of the photosensitive material can be maintained.

A third aspect of the present invention is a method of operating a photosensitive material processing apparatus in which a processing rack is set in each of at least one processing tanks which each store a processing solution, the processing rack rotatably supporting conveying rollers for conveying a photosensitive material, the method comprising the steps of: conducting predetermined control for the photosensitive material processing apparatus in a state in which the rotation of the conveying rollers is stopped; and rotating the conveying rollers for a predetermined amount of time and then stopping the rotation of the conveying rollers, in association with the predetermined control for the photosensitive material processing apparatus.

In accordance with the third aspect of the present invention, in the same way as in the first aspect, a processing rack which rotatably supports the conveying rollers for conveying the photosensitive material is set in each of the processing tanks which each store a processing solution.

While a control program which operates the photosensitive material processing apparatus is being executed in a state in which the rotation of the conveying rollers is stopped, the controller rotates the conveying rollers for a predetermined amount of time and then stops the rotation thereof.

Accordingly, while the control program which operates the photosensitive material processing apparatus is being carried out in a state in which the rotation of the conveying rollers is stopped (for example, during preheating of the processing solution using a timer), in the same manner as in the first aspect, the deposition and precipitation of the suspended materials on the conveying rollers is reliably prevented, so that the high quality of the photosensitive material can be maintained.

DESCRIPTION OF THE PREFERRED EMBODIMENTS

A photosensitive material processing apparatus to which a first embodiment of the present invention is applied will be described on the basis of the drawings.

Figure 1:
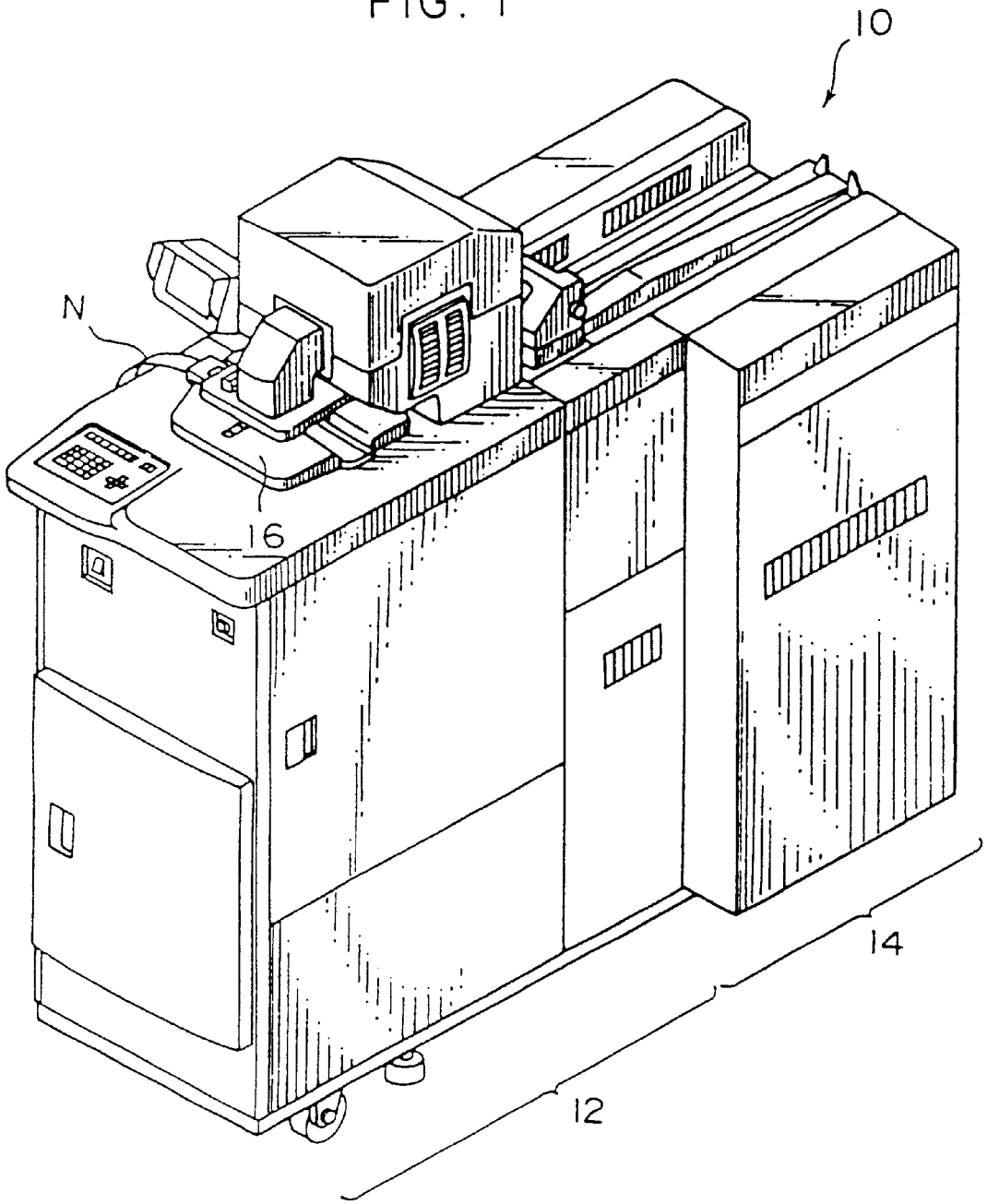
FIG. 1 is a perspective view of a printer processor to which embodiments of the present invention are applyied.

FIG. 1 is a schematic perspective view of the overall structure of a printer processor 10 which is a photosensitive material processing apparatus to which the present embodiment is applied.

The printer processor 10 includes a printer section 12 and a processor section 14. At the printer section 12, images of a negative film N set on a negative carrier 16 are printed onto a photographic printing paper C which is a photosensitive material. The photographic printing paper C is then conveyed to the processor section 14.

Figure 2:
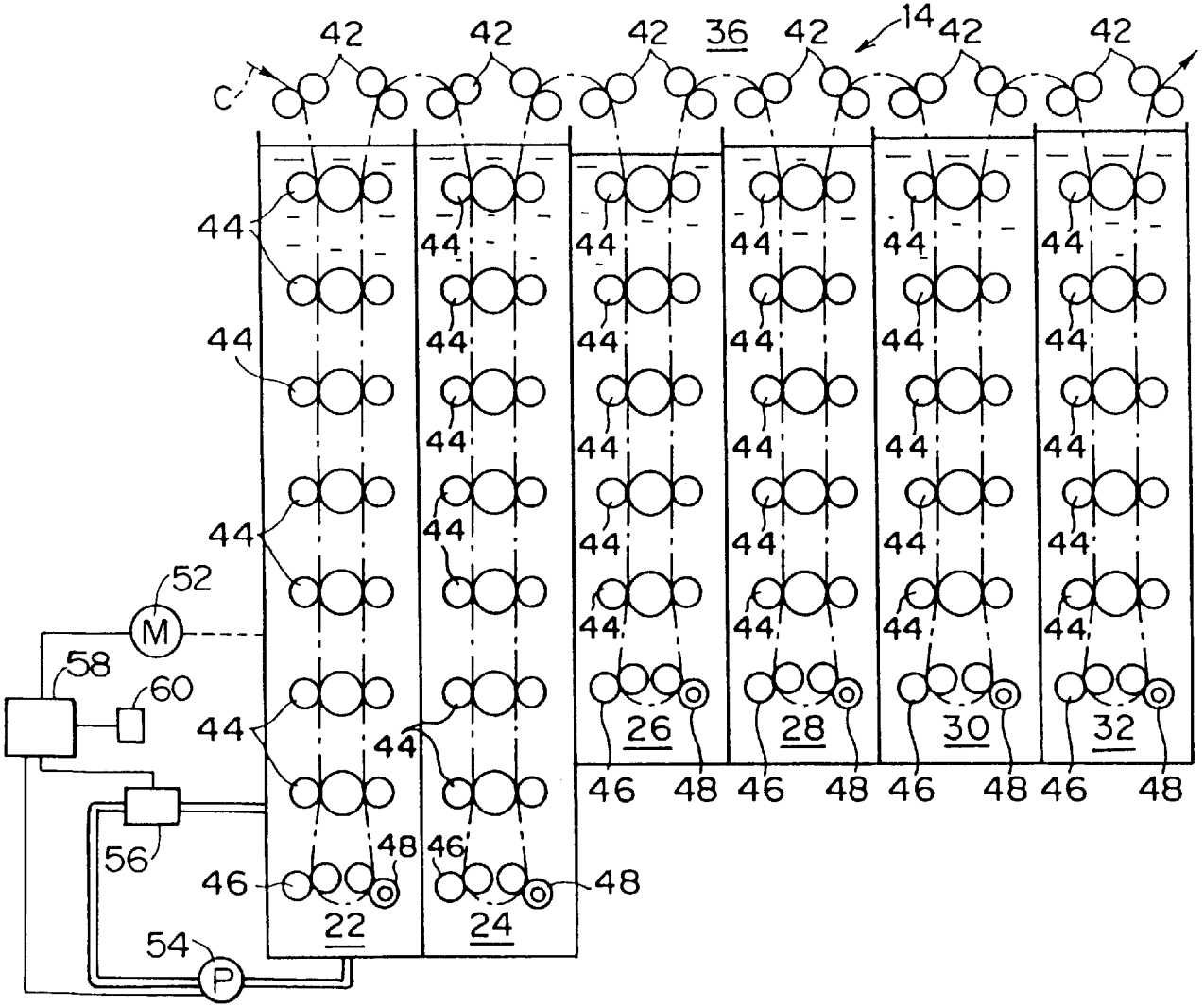
FIG. 2 is a cross-sectional view of a processor section of the printer processor of FIG. 1, and shows a conveying system.

As shown in FIG. 2, in the processor section 14, a developing tank 22, a bleach-fixing tank 24, a first rinsing tank 26, a second rinsing tank 28, a third rinsing tank 30, a fourth rinsing tank 32 and a drying portion (not shown) are provided. The photographic printing paper C conveyed from the printer section 12 is processed therein.

More specifically, in the processor section 14, the developing tank 22, the bleach-fixing tank 24, the first rinsing tank 26, the second rinsing tank 28, the third rinsing tank 30 and the fourth rinsing tank 32, each of which serves as a processing tank, are disposed in series. Each tank is filled with a predetermined amount of a corresponding processing solution for processing the photographic printing paper C such as developer, bleach-fixing solution and rinsing water.

Figure 3:
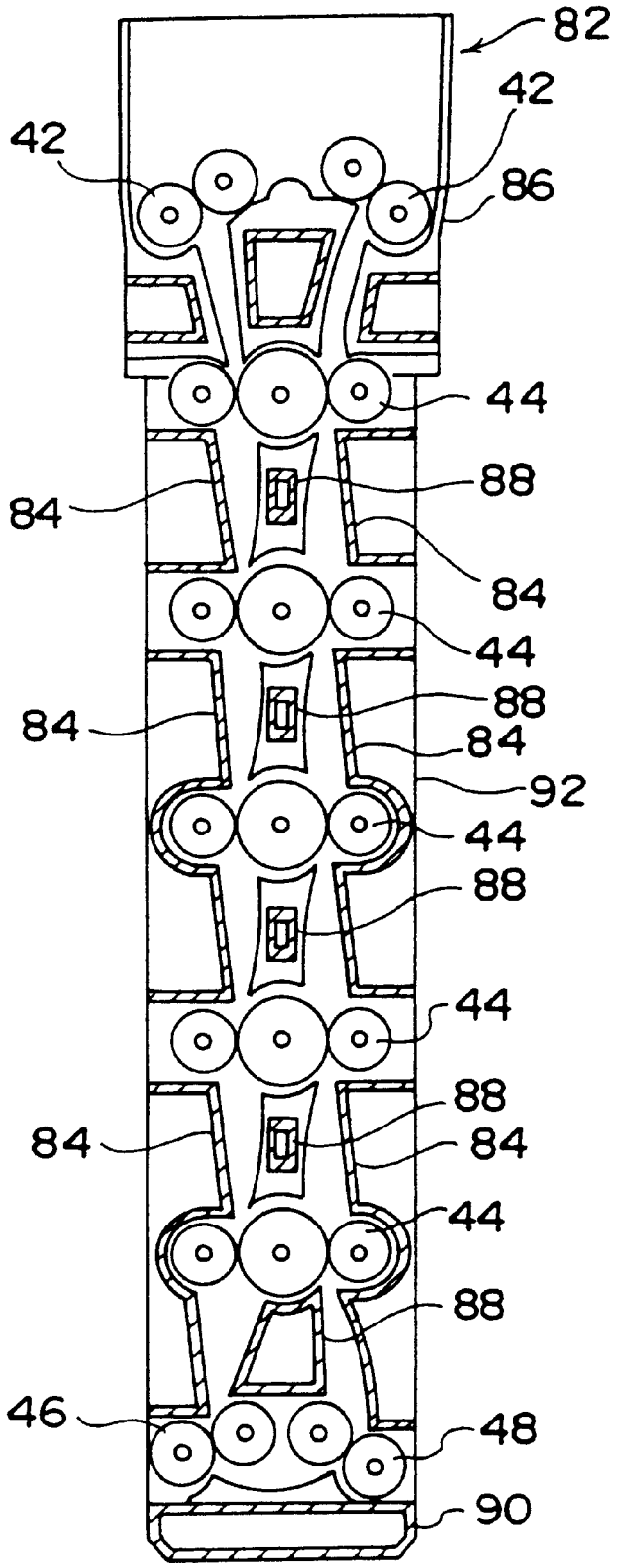
FIG. 3 is a cross-sectional view of a processing rack in the processor section of FIG. 2.

A plurality of sets of conveying rollers, each set consisting of a plurality of rollers, are rotatably supported at a processing rack 82 as shown in FIG. 3, such that the photographic printing paper C can be nipped and conveyed sequentially by the conveying rollers. The processing rack 82 is set in each processing tank.

Further, a gear (not illustrated) is attached to an end portion of each of the conveying rollers 42,44,46 and 48. By way of a gear mechanism which is not illustrated, a motor 52 as a driving source and set in the printer processor 10 transmits driving force to these conveying rollers 42, 44, 46 and 48. Accordingly, by rotating the conveying rollers 42, 44, 46 and 48 by using the driving force transmitted from the motor 52 and conveying the photographic printing paper C, the photographic printing paper C is introduced sequentially into each processing tank and is processed.

The printer processor 10 is also equipped with a circulation pump 54 (see FIG. 2) for circulating the processing solution in each processing tank. On the circulation path of the processing solution, a heater 56 for controlling the temperature of the processing solution is provided, and the heater 56 heats the circulating processing solution. Although FIG. 2 illustrates only one circulation pump 54 and one heater 56, each processing tank may be provided with at least one circulation pump 54 and at least one heater 56 in practice.

The motor 52 and circulation pump 54 are connected to a controller 58 serving as a controlling means, and the controller 58 is connected to a timer 60 which counts time. Thus, the controller 58 not only controls the operations of the motor 52, the circulation pump 54 and the heater 56 on the whole, but also controls the motor 52, the circulation pump 54 and the heater 56 individually so that they can be operated separately from one another when the timer 60 counts a predetermined amount of time (that is, at a predetermined timing).

Next, each processing tank in the processor section 14 will be described in detail.

As shown in FIG. 2, on the conveying path of the photographic printing paper C directly above the upper end portions of the respective processing tanks (that is, directly above the surfaces of the processing solutions in the respective tanks), a cross-over rack 36 is provided such that the direction of the conveying path of the photographic printing paper C is reversed thereby.

Guides (not illustrated) for guiding the photographic printing paper C and a pair of conveying rollers 42 are provided within the cross-over rack 36 at each of the photographic printing paper C conveying direction upstream and downstream sides of the processing solutions stored in the respective processing tanks (i.e., directly above the processing solutions in the respective processing tanks).

In the processing solution in the developing tank 22, seven sets of conveying rollers 44 are disposed along a vertical direction. Further, each set of these seven sets of conveying rollers 44 includes a roller having a diameter of 30 mm and a pair of rollers each having a diameter of 20 mm and disposed at either side of the 30 mm diameter roller. In addition, at the lowest end portion of the developing tank 22, a pair of first-turn conveying rollers 46 and a pair of second-turn conveying rollers 48 are disposed, such that the conveying direction of the photographic printing paper C can be changed thereby.

In the processing solution in the bleach-fixing tank 24, seven sets of conveying rollers 44 are disposed in a vertical direction in the same manner as in the developing tank 22, and at the lowest end portion of the bleach-fixing tank 24, first-turn conveying rollers 46 and second-turn conveying rollers 48 are disposed in the same manner as in the developing tank 22.

Further, in each of the first rinsing tank 26 to the fourth rinsing tank 32 for rinsing chemicals and the like adhered to the photographic printing paper C, five sets of conveying rollers 44 are disposed in series along a vertical direction. At the lowest end portion of the each of the first rinsing tank 26 to the fourth rinsing tank 32, first-turn conveying rollers 46 and second-turn conveying rollers 48 are disposed in the same manner as in the developing tank 22.

Accordingly, as shown in FIG. 2, when the photographic printing paper C nipped by the conveying rollers 44 is conveyed downward in each processing 'tank, the conveying direction is changed by the first-turn conveying rollers 46 and the second-turn conveying rollers 48, and then the photographic printing paper C is conveyed upward by the conveying rollers 44. Further, when the photographic printing paper C is discharged from the processing tank, the photographic printing paper C is nipped by the conveying rollers 42 of the cross-over rack 36 and the conveying direction thereof is changed by the conveying rollers 42 of the cross-over rack 36 while the photographic printing paper C remains nipped. Then, the photographic printing paper C is fed into the next processing tank. The photographic printing paper C is conveyed in the same manner in the next processing tank.

It is preferable that the conveying rollers 44, 46 and 48 are disposed so as to always be immersed in the processing solution (even when the level of the processing solution has dropped due to evaporation).

As shown in FIG. 3, the processing rack 82 has conveying rollers 42, 44, 46 and 48 and a pair of side panels 92 (only one is shown) which support the conveying rollers 42, 44, 46 and 48. Further, the processing rack 82 is structured such that outer guides 84, an upper guide 86, middle guides 88 and a lower guide 90 are disposed between the pair of side panels 92. Each guide guides the photographic printing paper C when the photographic printing paper C is conveyed.

Next, the processing operation carried out by the printer processor 10 of the first embodiment will be described.

The plurality of processing tanks, each of which stores a processing solution, are provided along the conveying direction of the photographic printing paper C, and the processing rack 82 for conveying the photographic printing paper C is disposed in each processing tank. The conveying rollers 42, 44, 46 and 48 supported at the processing rack 82 nip and convey the photographic printing paper C in to and out from of the processing tank which stores the processing solution.

As a result, the photographic printing paper C fed into the processor section 14 is guided by the guides 84, 86, 88 and 90 in the processing rack 82 provided in each processing tank, to thereby undergo developing, bleach-fixing and rinsing processings.

Next, a method of operating the printer processor 10 relating to the first embodiment will be described in detail.

Figure 4:
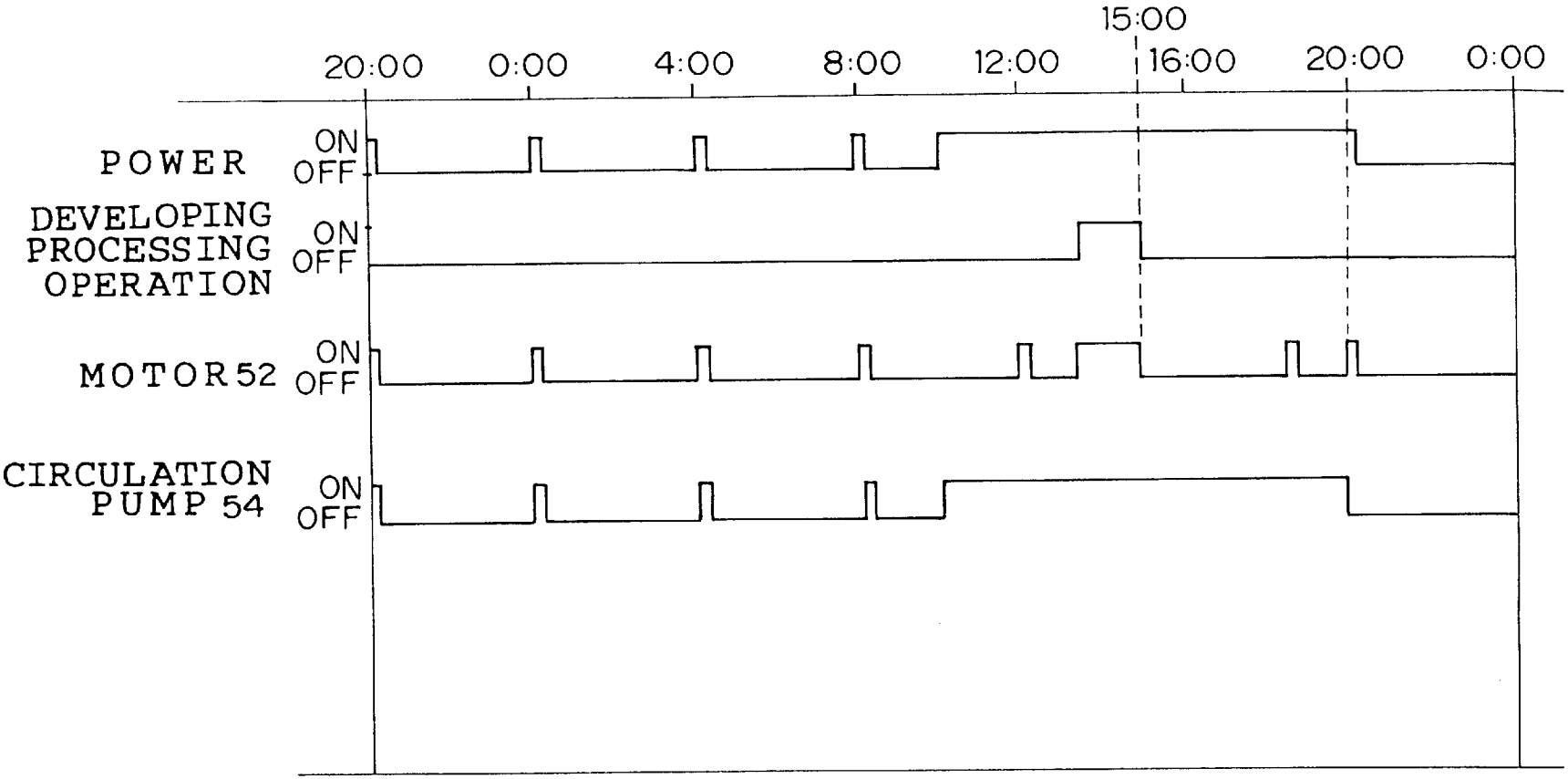
FIG. 4 is a time chart showing a method of operating the printer processor relating to a first embodiment of the present invention.

As shown in FIG. 4, when the developing processing operation is completed, the driving of the motor 52 is stopped such that the rotation of the conveying rollers 42, 44, 46 and 48 is stopped. Then, when the rotation of the conveying rollers 42, 44, 46 and 48 stops, the timer 60 is started. In other words, when the developing processing operation is completed and the rotation of the conveying rollers 42, 44, 46 and 48 stops at, for example, 15:00 (3:00 pm), the timer 60 starts to operate and count time.

At the timing when the timer 60 has counted, for example, four hours as a specified amount of time (that is, at 19:00 (7:00 pm)), the controller 58 rotates the conveying rollers 42, 44, 46 and 48 for a predetermined amount of time (e.g., one minute), and then stops the rotation thereof. At the same time and for the same period of time that the controller 58 rotates the conveying rollers 42, 44, 46 and 48, the controller 58 operates the circulation pump 54, and then stops the operation thereof. However, if the circulation pump 54 is constantly on (in FIG. 4, between around 10:00 and 20:00), the circulation pump 54 is not stopped.

Then, when the rotation of the conveying rollers 42, 44, 46 and 48 is stopped, the timer 60 is reset and is started again. This operation is repeated once every four hours, which is the specified amount of time counted by the timer 60. It should be noted that, in the present first embodiment, the start of time counting by the timer 60, which starts when the conveying rollers 42, 44, 46 and 48 in the processing rack 82 are rotated and then stopped at the end of a day's operation, may differ each day.

More specifically, as shown in FIG. 4, when a day's operation is completed and the operator turns the power switch of the printer processor 10 off at, for example, 20:00, the motor 52 operates automatically for a specified amount of time on the basis of an ending program installed in the controller 58 in advance, in spite of the fact that the power has been switched off. Accordingly, the conveying rollers 42, 44, 46 and 48 rotate for a predetermined amount of time so that the conveying rollers 42 in the cross-over rack 36 are cleaned. When the rotation of the rollers is stopped after the predetermined amount of time has elapsed, i.e., when the cleaning is completed, the timer 60 is reset in association with this stoppage of the rollers, and starts the counting operation again.

At the next time (e.g., at 0:00) which is the end of the counting of the predetermined amount of time by the timer 60, the controller 58 turns the power on again and rotates the conveying rollers 42, 44, 46 and 48 for a specified amount of time such as one minute in the same manner as described above, and then stops the rotation thereof and turns the power off again.

The controller 58 repeats the same operation as described above at a predetermined timing (i.e., each time a predetermined period of time passes). (However, the operation in accordance with the present invention is not carried out when the apparatus is off for a very long period of time, for example, for 65 hours or longer.)

Accordingly, because long-term stoppage of the conveying rollers 44, 46 and 48 can be prevented, materials suspended in the processing solution in the processing tank are unlikely to be deposited on and precipitated on the conveying rollers 44, 46 and 48. Thus, substantially no suspended materials are transferred to the first photographic printing paper C processed by the printer processor 10 after the printer processor 10 is actuated. Therefore, high quality prints which are not dirtied can always be obtained.

As a result, even if rotation of the rollers has been stopped for a long period of time (such as cases in which the rollers are stopped when the temperature of the processing solution is being adjusted by a heater or cases in which the power of the photosensitive material processing apparatus is off), depositing and precipitation of suspended materials on the conveying rollers 44, 46 and 48 is reliably prevented, so that the high quality of the photographic printing paper C can be maintained.

Next, the controlling operation carried out by the controller 58 at the time of rotating the conveying rollers 42, 44, 46 and 48 for a specified amount of time and then stopping the rollers will be described hereinafter on the basis of FIG. 5.

Figure 5:
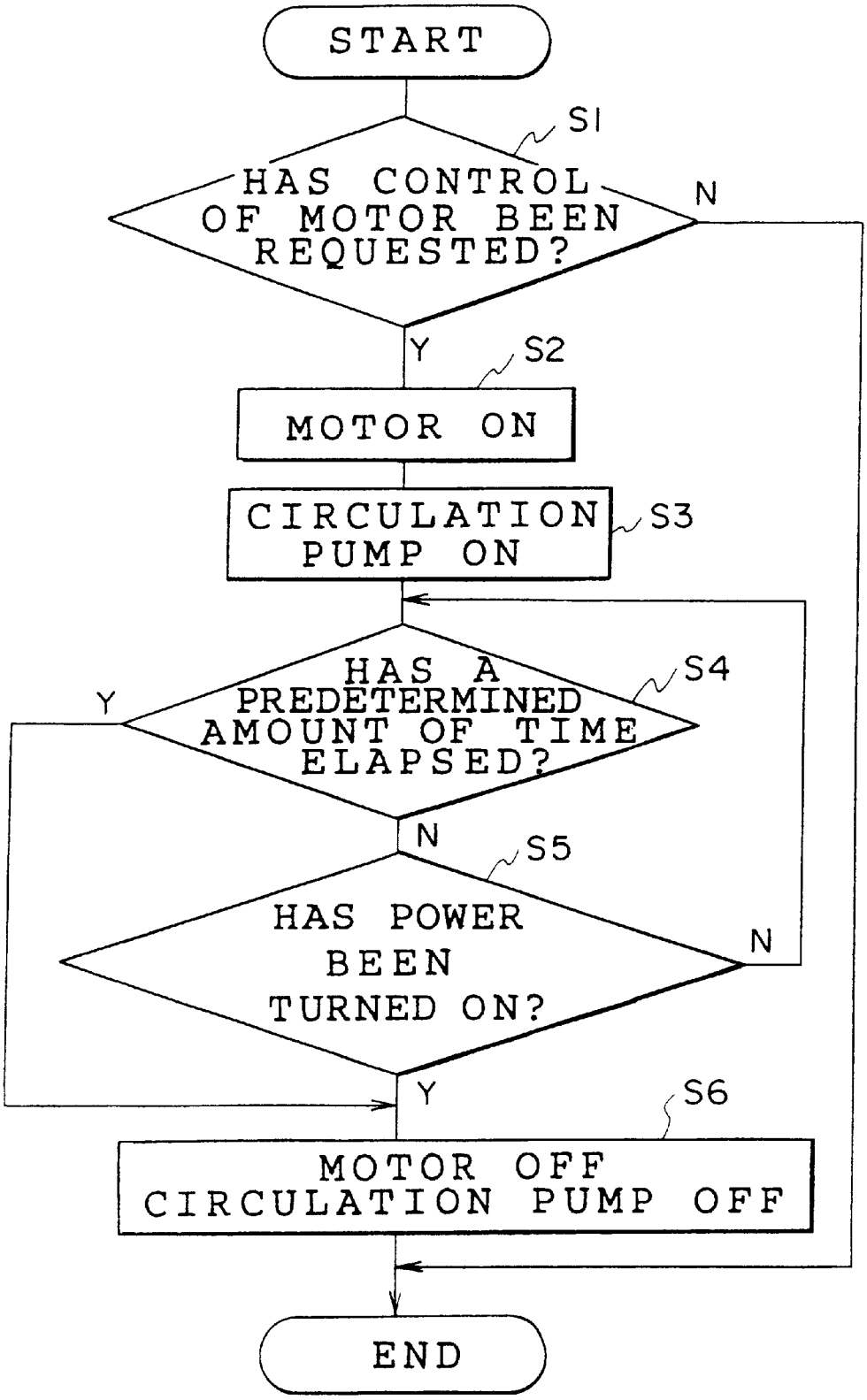
FIG. 5 is a flow chart showing the method of operating the printer processor relating to the first embodiment of the present invention.

When processing is started at "Start" in FIG. 5, it is judged in step S1 whether driving of the motor 52 has been requested. If driving of the motor 52 has not been requested, the routine proceeds to "End" and the control ends. On the other hand, if driving of the motor 52 has been requested, the controller 58 turns the motor 52 on in step S2, and at the same time turns the circulation pump 54 on in step S3, so that the conveying rollers 42, 44, 46 and 48 are rotated and the circulation pump 54 is operated at the same time.

Next, it is judged in step S4 whether or not a predetermined amount of time has elapsed. If the predetermined amount of time has not elapsed, the routine proceeds to step S5, and in step S5 it is judged whether the power switch has been turned on. If the power switch has not been turned on, the routine returns to step S4. If it is judged in step S5 that the power switch has been turned on, the routine proceeds to step S6, and the motor 52 and the circulation pump 54 are forcibly turned off.

This processing is repeated until the predetermined amount of time has elapsed. When it is judged in step S4 that the predetermined amount of time has elapsed, the processing proceeds to step S6, and in step S6 the controller 58 turns the motor 52 off and at the same time turns the circulation pump 54 off, so that the operations thereof are ended.

Figure 6:
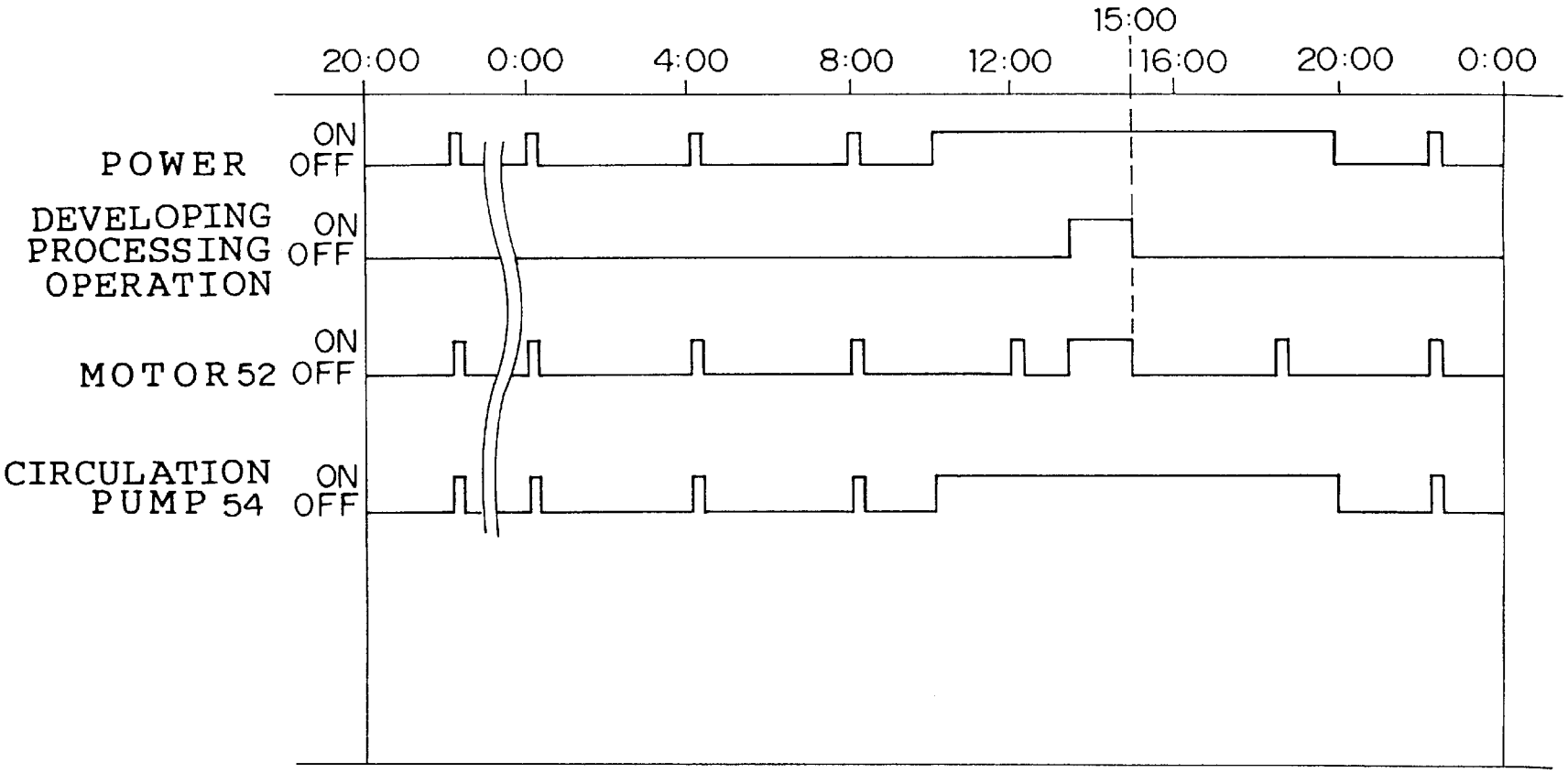
FIG. 6 is a time chart showing a modified example of the method of operating the printer processor relating to the first embodiment of the present invention.

In the present embodiment, while operations for completing a day's processing and shutting down the apparatus are carried out, the cleaning of the conveying rollers 42 in the cross-over rack 36 is executed. However, the cleaning of the conveying rollers 42 in the cross-over rack 36 may be omitted. In the latter case, the timer 60 is not reset at 20:00 as shown in FIG. 6. It should be noted that the time chart in FIG. 6 differs from those of FIGS. 4, 7 and 8 in that, in FIG. 6, a break line is included between the first (left-hand side) 20:00 and 0:00. This is to show that, in FIG. 6, the 20:00 at the right-hand end of the time chart is the 20:00 of the same day as the 20:00 at the left-hand end (i.e., the same time period after 20:00 on the same day is illustrated twice in FIG. 6). In contrast, the time charts of FIGS. 4, 7 and 8 follow the linear progression of time, with the first 20:00 being that of day X, the day changing to X+1 at the next marked time 0:00, and the final marked time 0:00 at the farthest right side of the figure being 0:00 of day X+2.

Next, referring to FIG. 7, a second embodiment of the present invention will be described. The second embodiment is the same as the foregoing first embodiment except for the method of operating the printer processor 10. Therefore, hereinafter, detailed description regarding points which are the same as the first embodiment will be omitted, and only the method of operating the printer processor 10 will be described.

Figure 7:
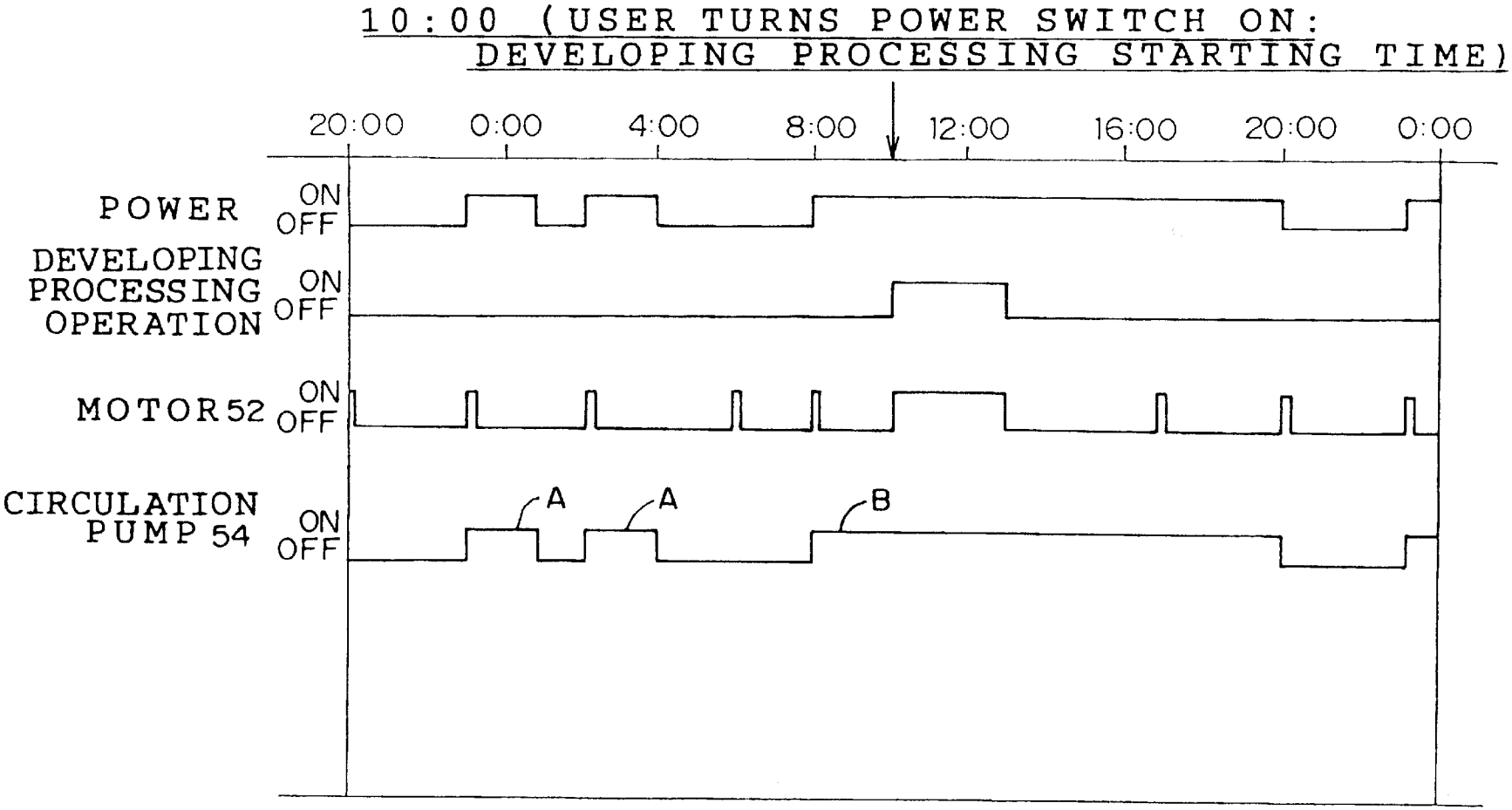
FIG. 7 is a time chart showing a method of operating the printer processor relating to a second embodiment of the present invention.

As shown in FIG. 7, in the second embodiment, operations such as preheating A and timer actuating B are conducted in the state in which the motor 52 is stopped and the rotation of the conveying rollers 42, 44, 46 and 48 is stopped. When the operations such as preheating A and timer actuating B are conducted, in association with such operations, the controller rotates the conveying rollers 42, 44, 46 and 48 for a predetermined amount of time, and then stops the rotation thereof.

In other words, in the present second embodiment, an operating program, in which the controller 58 rotates the conveying rollers 42, 44, 46 and 48 for a predetermined amount of time in association with the predetermined operations such as preheating A and timer actuating B with the motor 52 stopped and thus the rotation of the conveying rollers 42, 44, 46 and 48 stopped, is incorporated into the control program for conducting those predetermined operations.

Further, in the present second embodiment, a control program is incorporated in which the timer 60 starts counting when the conveying rollers 42, 44, 46 and 48 stop rotating, and at the time when the timer 60 has counted a specified amount of time (for example, four hours), the controller rotates the conveying rollers 42, 44, 46 and 48 again for a predetermined amount of time and then stops the rotation thereof, and when the timer 60 reset by the stoppage of the rotation of the conveying rollers has counted the same specified amount of time, the above-described operations are repeated.

Accordingly, in the case that the printer processor operations such as preheating A are conducted in the state in which the rotation of the conveying rollers 42, 44, 46 and 48 is stopped, the deposition and precipitation of the suspended materials on the conveying rollers 44, 46 and 48 is reliably prevented, so that the high quality of the photographic printing paper C can be maintained.

Preheating A herein refers to the preheating of the processing solution for preventing the temperature thereof from dropping, and timer actuating B herein refers to the preheating of the processing solution initiated by the timer 60 prior to starting operation. A user sets the printer processor 10 so that each of the circulation pump 54 and the heater 56 operates automatically during the night, so that the preheating A and the timer actuating B are executed then.

In the present second embodiment, when the timing of the intermittent driving of the conveying rollers 42, 44, 46 and 48 resulting from the timer 60 counting a specified amount of time overlaps with another control (such as the above-described preheating A or timer actuating B), another control is preferable and the operation of the intermittent driving of the conveying rollers 42, 44, 46 and 48 is canceled, and the timer 60 is reset. Then, when the conveying rollers 42, 44, 46 and 48 are again (rotated and) stopped in association with another control, the timer 60 is started again (that is, the control of the intermittent driving of the conveying rollers 42, 44, 46 and 48 is resumed).

The operations of rotating the conveying rollers 42, 44, 46 and 48 intermittently may include only rotation of the conveying rollers 42, 44, 46 and 48 (the example shown in FIG. 7), or may include the rotation of the conveying rollers 42, 44, 46 and 48 in association with operation of the circulation pump 54, or may include the rotation of the conveying rollers 42, 44, 46 and 48 in association with operation of the circulation pump 54 and the heater 56.

Herein, the cases in which the timer 60 is to be reset include, not only the cases in which the conveying rollers 42, 44, 46 and 48 are rotated and stopped at the time of processing the photographic printing paper C and at the time of cleaning the conveying rollers 42 in the cross-over rack 36 while operations for completing a day's processing and shutting down the apparatus are carried out, but also the case in which the conveying rollers 42, 44, 46 and 48 are rotated and stopped when a test print is printed at the time of starting operation.

The timer 60 may be reset at a specific time or when the power switch of the printer processor 10 is turned on. The timer is started immediately after being reset, and the conveying rollers 42, 44, 46 and 48 are rotated each time a specified amount of time passes as measured by the timer 60 in the same manner as described above.

In the second embodiment, as described above, an example in which control for intermittently driving the conveying rollers 42, 44, 46 and 48 is conducted by counting a specified amount of time using the timer 60 has been explained. However, as a modified example, intermittent driving of the conveying rollers 42, 44, 46 and 48 using the timer 60 may be omitted.

Figure 8:
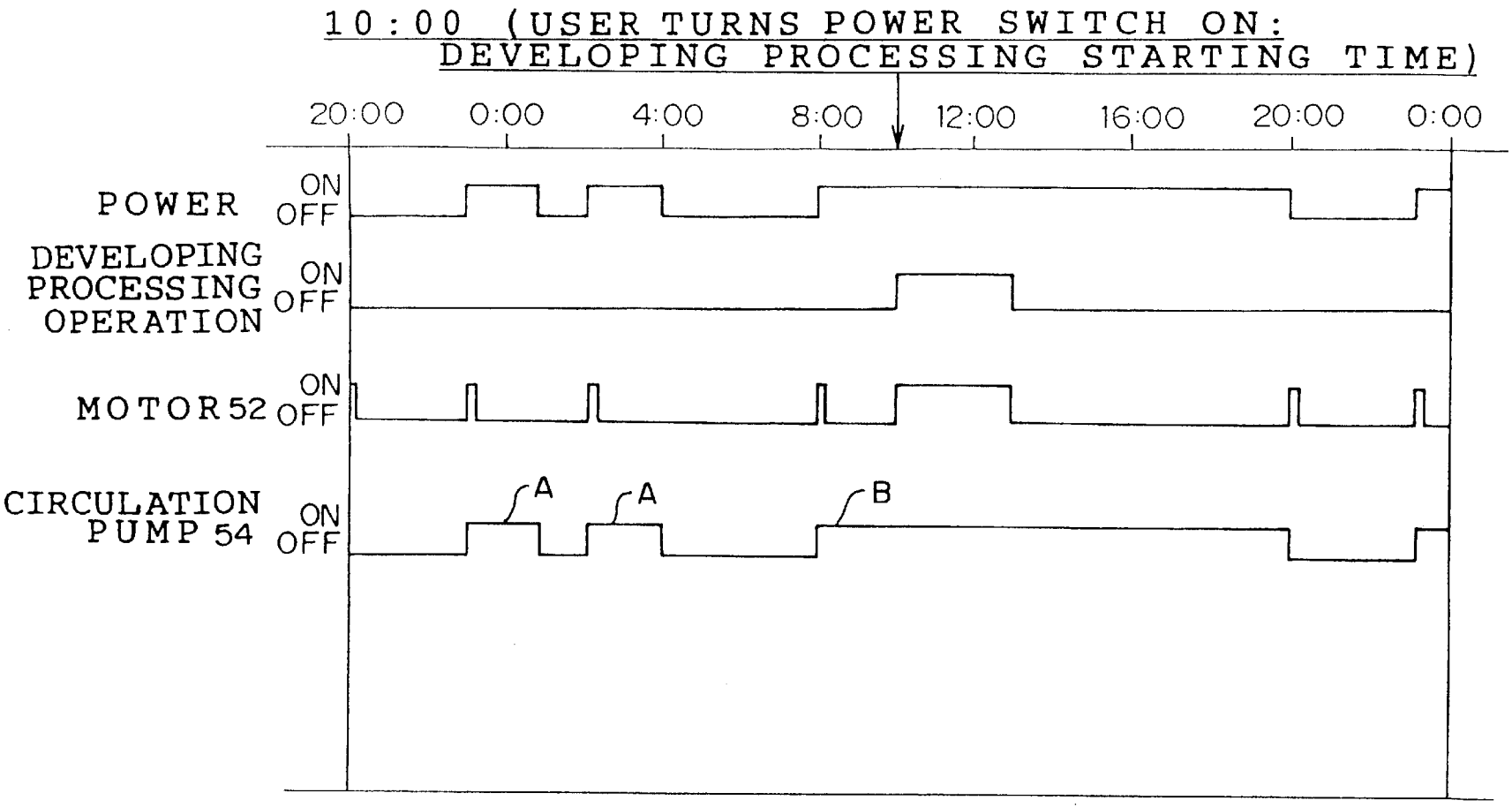
FIG. 8 is a time chart showing a modified example of the method of operating the printer processor relating to the second embodiment of the present invention.

Namely, as shown in FIG. 8, the operation of rotating the conveying rollers 42, 44, 46 and 48 for the predetermined amount of time and then stopping the rotation thereof may be associated only with a control such as preheating A and timer actuating B.

In the above-described embodiments, the operation of rotating the conveying rollers 42, 44, 46 and 48 for one minute every four hours is repeated. However, these times are only examples, and it is to be understood that these times can be changed as desired.

Moreover, although the above embodiments describe examples of applying the present invention to the printer processor 10 which develops the photographic printing paper C, it is to be understood that the present invention is also applicable to photosensitive material processing apparatuses which process films such as negative films and other kinds of photosensitive materials.

As described above, due to the above structure, the method of operating the photosensitive material processing apparatus of the present invention has the superior effect that even if the rotation of the conveying rollers is stopped for a long time, deposition and precipitation of the suspended materials on the conveying rollers is reliably prevented so as not to result in degradation of the quality of the photosensitive materials.

What is claimed is:

1. A method of operating a photosensitive material processing apparatus in which a processing rack is set in each of at least one processing tanks which each store a processing solution, the processing rack rotatably supporting conveying rollers for conveying a photosensitive material, said method comprising the steps of:

starting a timer when rotation of the conveying rollers is stopped;

rotating the conveying rollers for a predetermined amount of time at the time when the timer has counted a specified amount of time, and then stopping the rotation of the conveying rollers on the basis of a command from a controller;

resetting and restarting the timer when the rotation of the conveying rollers is stopped; and repeating the above steps.

2. A method of operating a photosensitive material processing apparatus according to claim 1, wherein said step of rotating the conveying rollers for the predetermined amount of time at the time when said timer has counted the specified amount of time, and then stopping the rotation of the conveying rollers on the basis of the command from the controller, includes a step of rotating the conveying rollers by turning a motor on at the time when said timer has counted the specified amount of time on the basis of a command from the controller.

3. A method of operating a photosensitive material processing apparatus according to claim 2, wherein said step of rotating the conveying rollers by turning the motor on at the time when said timer has counted the specified amount of time on the basis of the command from the controller, includes a step of turning a circulation pump on in association with the operation of turning the motor on.

4. A method of operating a photosensitive material processing apparatus according to claim 3 comprising a step of turning said motor and said circulation pump off and ending the control carried out in each of said steps, in a case in which the operation of turning the motor on has been noticed during the time said timer is counting the specified amount of time.

5. A method of operating a photosensitive material processing apparatus according to claim 1 comprising a step of resetting said timer at a specific resetting time.

6. A method of operating a photosensitive material processing apparatus according to claim 1 comprising a step of resetting said timer when the power switch of printer processor is turned on.

7. The method according to claim 1, wherein the processing apparatus includes a plurality of processing tanks, and wherein the conveying rollers to be rotated for a predetermined amount of time in said rotating step are supported by the processing rack such that the conveying rollers are completely immersed in the processing solution in each of said plurality of processing tanks.

8. The method of claim 7 wherein the processing solution stored in one of said plurality of processing tanks includes at least one of: a fixing solution and a washing solution.

9. A method of operating a photosensitive material processing apparatus in which a processing rack is set in each of at least one processing tanks which each store a processing solution, the processing rack rotatably supporting conveying rollers for conveying a photosensitive material, said method comprising the steps of:

starting a timer when the power of the photosensitive material processing apparatus is turned off;

turning the power of the photosensitive material processing apparatus on at the time when the timer has counted a specified amount of time, and rotating the conveying rollers for a predetermined amount of time on the basis of a command from a controller;

stopping the rotation of the conveying rollers, and turning the power off in the state in which the rotation of the conveying rollers is stopped;

resetting and restarting the timer when the power is turned off; and repeating the above steps.

10. A method of operating a photosensitive material processing apparatus according to claim 9, wherein said step of turning the power of the photosensitive material processing apparatus on at the time when said timer has counted the specified amount of time, and rotating the conveying rollers for the predetermined amount of time on the basis of the command from the controller, includes a step of rotating the conveying rollers by turning a motor on at the time when said timer has counted the specified amount of time on the basis of a command from the controller.

11. A method of operating a photosensitive material processing apparatus according to claim 10, wherein said step of rotating the conveying rollers by turning the motor on at the time when said timer has counted the specified amount of time on the basis of the command from the controller, includes a step of turning a circulation pump on in association with the operation of turning the motor on.

12. A method of operating a photosensitive material processing apparatus according to claim 11 comprising a step of turning said motor and said circulation pump off and ending the control carried out in each of said steps, in a case in which the operation of turning the motor on has been noticed during the time said timer is counting the specified amount of time.

13. A method of operating a photosensitive material processing apparatus according to claim 9, further comprising the steps of:

starting the timer when the rotation of said conveying rollers is stopped;

rotating the conveying rollers for the predetermined amount of time at the time when said timer has counted the specified amount of time, and then stopping the rotation of the conveying rollers on the basis of a command from a controller;

resetting and restarting the timer when the rotation of the conveying rollers is stopped; and repeating the above steps.

14. A method of operating a photosensitive material processing apparatus according to claim 13 comprising a step of canceling the time at which the counting is to be started when the rotation of the conveying rollers stops, in a case in which the time at which the counting starts when the power of the photosensitive material processing apparatus is turned off is different from the time at which the counting starts when the rotation of the conveying rollers stops.

15. The method according to claim 9, wherein the processing apparatus includes a plurality of processing tanks, and wherein the conveying rollers to be rotated for a predetermined amount of time in said rotating step are supported by the processing rack such that the conveying rollers are completely immersed in the processing solution in each of said plurality of processing tanks.

16. The method of claim 15 wherein the processing solution stored in one of said plurality of processing tanks includes at least one of: a fixing solution and a washing solution.

17. A method of operating a photosensitive material processing apparatus in which a processing rack is set in each of at least one processing tanks which each store a processing solution, the processing rack rotatably supporting conveying rollers for conveying a photosensitive material, said method comprising the steps of:

conducting predetermined control for the photosensitive material processing apparatus in a state in which the rotation of said conveying rollers is stopped; and rotating said conveying rollers for a predetermined amount of time and then stopping the rotation of said conveying rollers, in association with said predetermined control for the photosensitive material processing apparatus.

18. A method of operating a photosensitive material processing apparatus according to claim 17, further comprising the steps of:

starting a timer when the rotation of said conveying rollers is stopped;

rotating the conveying rollers for the predetermined amount of time at the time when said timer has counted a specified amount of time, and then stopping the rotation of the conveying rollers on the basis of a command from a controller;

resetting and restarting the timer when the rotation of the conveying rollers is stopped; and repeating the above steps.

19. A method of operating a photosensitive material processing apparatus according to claim 17, wherein said step of rotating said conveying rollers for the predetermined amount of time and then stopping the rotation of said conveying rollers, in association with said predetermined control for the photosensitive material processing apparatus, includes a step of operating a circulation pump at the same time of operating said conveying rollers.

20. A method of operating a photosensitive material processing apparatus according to claim 19, wherein said step of operating the circulation pump at the same time of operating said conveying rollers includes a step of operating the circulation pump and a heater at the same time of operating said conveying rollers.

21. A method of operating a photosensitive material processing apparatus according to claim 18, wherein said step of rotating the conveying rollers for the predetermined amount of time at the time when said timer has counted the specified amount of time and then stopping the rotation of the conveying rollers on the basis of the command from the controller, includes a step of operating a circulation pump at the same time of operating said conveying rollers.

22. A method of operating a photosensitive material processing apparatus according to claim 21, wherein said step of rotating the conveying rollers for the predetermined amount of time by the controller at the time when said timer has counted the specified amount of time and then stopping the rotation of the conveying rollers on the basis of the command from the controller, includes a step of operating the circulation pump and a heater at the same time of operating said conveying rollers.

23. A method of operating a photosensitive material processing apparatus according to claim 17 comprising a step of resetting said timer at a specific resetting time.

24. A method of operating a photosensitive material processing apparatus according to claim 17 comprising a step of resetting said timer when the power switch of printer processor is turned on.

25. The method according to claim 17, wherein the processing apparatus includes a plurality of processing tanks, and wherein the conveying rollers to be rotated for a predetermined amount of time in said rotating step are supported by the processing rack such that the conveying rollers are completely immersed in the processing solution in each of said plurality of processing tanks.

26. The method of claim 25 wherein the processing solution stored in one of said plurality of processing tanks includes at least one of: a fixing solution and a washing solution.

* * * * *